US009759417B2

(12) United States Patent
Lin

(10) Patent No.: US 9,759,417 B2
(45) Date of Patent: Sep. 12, 2017

(54) LED DEVICE

(71) Applicant: Ruei-Hsing Lin, New Taipei (TW)

(72) Inventor: Ruei-Hsing Lin, New Taipei (TW)

( * ) Notice: Subject to any disclaimer, the term of this patent is extended or adjusted under 35 U.S.C. 154(b) by 193 days.

(21) Appl. No.: 14/838,382

(22) Filed: Aug. 28, 2015

(65) Prior Publication Data

US 2017/0059144 A1 Mar. 2, 2017

(51) Int. Cl.

| | |
|---|---|
| ***F21V 29/00*** | (2015.01) |
| ***F21V 29/70*** | (2015.01) |
| ***F21V 19/00*** | (2006.01) |
| ***F21V 23/06*** | (2006.01) |
| ***F21V 15/01*** | (2006.01) |
| ***F21S 4/28*** | (2016.01) |
| *F21Y 103/10* | (2016.01) |
| *F21Y 115/10* | (2016.01) |

(52) U.S. Cl.

CPC ..... *F21V 29/70* (2015.01); *F21S 4/28* (2016.01); *F21V 15/01* (2013.01); *F21V 19/0055* (2013.01); *F21V 23/06* (2013.01); *F21Y 2103/10* (2016.08); *F21Y 2115/10* (2016.08)

(58) Field of Classification Search

CPC ..... F21S 4/28; F21V 15/01; F21V 19/0055; F21V 23/06; F21V 29/70; F21Y 2103/10; F21Y 2115/10

USPC ..... 362/294, 217.01, 218, 249.01, 227, 240, 362/249.02, 373, 648

See application file for complete search history.

(56) References Cited

U.S. PATENT DOCUMENTS

| | | | | |
|---|---|---|---|---|
| 5,499,170 | A * | 3/1996 | Gagne | B60Q 3/46 362/153 |
| 7,033,060 | B2 * | 4/2006 | Dubuc | A01G 7/045 362/218 |
| 7,101,056 | B2 * | 9/2006 | Pare | G09F 13/14 362/190 |
| 7,674,010 | B2 * | 3/2010 | Griffiths | F21V 11/10 362/240 |
| 7,936,561 | B1 * | 5/2011 | Lin | F21V 19/0055 165/185 |
| 2006/0083012 | A1 * | 4/2006 | Ter-Hovhannissian | B60Q 1/32 362/485 |

* cited by examiner

*Primary Examiner* — Renee Chavez
*Assistant Examiner* — Tsion Tumebo
(74) *Attorney, Agent, or Firm* — Jackson IPG PLLC; Demian K. Jackson

(57) ABSTRACT

The light emitting diode (LED) device contains an aluminum base, a LED lighting module, a heat dissipation plate, two insulating strips, a first conductive strip, and a second conductive strip. The conductive strips are wrapped in the insulating strips, which in turn are threaded in the aluminum base. The LED lighting module is joined to the aluminum base through convenient locking mechanism. The LED lighting module has connector assemblies at its two ends. Each connector assembly contains two terminals. When the LED lighting module is locked to the aluminum base, the two terminals electrically contact the two conductive strips, respectively. As such, the aluminum base and the LED lighting module can be quickly assembled, and the heat produced by the LED lighting module is effectively conducted onto the aluminum base and completely dissipated.

5 Claims, 6 Drawing Sheets

LED DEVICE

BACKGROUND OF THE INVENTION (a) Technical Field of the Invention

The present invention is generally related to lighting devices, and more particular to a lighting device using light emitting diodes (LEDs) as light source with enhanced heat dissipation and convenient assembly.

(b) Description of the Prior Art

The lighting industry has undergone significant progress from early high-wattage incandescent light bulbs, to fluorescent lamp tubes, and then to various energy-saving lamps such as PL (Philips Lighting) lamps.

As the concerns for environmental protection continuously increase, and energy saving becomes an international common consensus, energy-saving lamps become the main stream lighting devices. However, the conventional energy-saving lighting devices, even though whose efficiency is superior than that of the conventional lamps, is still inferior to the light emitting diode (LED) chips in terms of power consumption and operational life. In addition, the conventional energy-saving lamps are usually made of glass, which is hazardous for installation, transportation, and recycling.

The LEDs on the other hand seem to be a total solution to the constraints and limitations faced by the lighting industry.

According to the recent technology and literature, the LEDs indeed have advantages such as high brightness, long projection, low power consumption, good lighting characteristics, and low production cost. Especially due to their low power consumption and production cost, LEDs have the greatest potential as the next generation lighting source.

For high-power LEDs, effective heat dissipation is required so as to avoid the significant amount of heat from adversely affecting the LEDs' operational life and causing light attenuation. Therefore, heat dissipation modules become the pivotal component for the LED light devices.

The conventional heat dissipation modules are designed solely for heat dissipation. Electricity provision to the LED lighting devices is usually arranged separately and individually. When there are multiple LED lighting devices are involved, usually welding is required to connect these LED lighting devices together and their electricity provision becomes an issue, especially when the connection too long, and when power is attenuated due to repeated series and parallel connections. This problem would significantly limit the applicability of LED lighting devices.

To overcome the problem, the lighting industry has taught various solutions like external connection, wire connection, etc. However, these solutions cause increased cost and wiring complexity.

SUMMARY OF THE INVENTION

The present invention teaches a light emitting diode (LED) device which contains an aluminum base, a LED lighting module, a heat dissipation plate, two insulating strips, a first conductive strip, and a second conductive strip. The aluminum base contains two first channels arranged in parallel, and a heat dissipation channel therebetween. Each first channel has a top slot opening partially covered by at least a top wall. The aluminum base is configured with a first locking element adjacent to each top slot opening. Each insulating strip is threaded in a first channel and has a second channel with a second top slot opening, and a third channel connecting and tangent to the second channel Each conductive strip is threaded in the third channel of an insulating strip. The LED lighting module contains a circuit board with at least a connector assembly configured at an end of the circuit board. Each connector assembly contains a first terminal, a second terminal, and a bridge element with a second locking element. The heat dissipation plate is positioned between the aluminum base and the LED lighting module When the LED lighting module is joined to the aluminum base, and the second locking elements are locked to the corresponding first locking elements, the first terminal is extended into the second channel of an insulating strip through the first and second top slot openings, and contacts the first conductive strip. Similarly, the second terminal is extended into the second channel of another insulating strip through the first and second top slot openings, and contacts the second conductive strip. As such, the aluminum base and the LED lighting module can be quickly assembled, and the heat produced by the LED lighting module is effectively and completely conducted onto the aluminum base, whose convection space quickly guides the heat outside In addition, the locking between the second locking elements and the first locking elements mainly relies upon the flexibility of the bridge element. To remove or replace the LED lighting module, the second locking elements are pressed and the second locking elements would quickly break away from the first locking elements. Then, the LED lighting module can be easily separated from the aluminum base and replaced.

Furthermore, the first and second conductive strips are for providing electricity to the LED lighting module. The advantages are convenience, flexibility in adapting to various length requirement, and reliable and uniform electricity provision, effectively resolving the problems of insufficient power and light attenuation.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
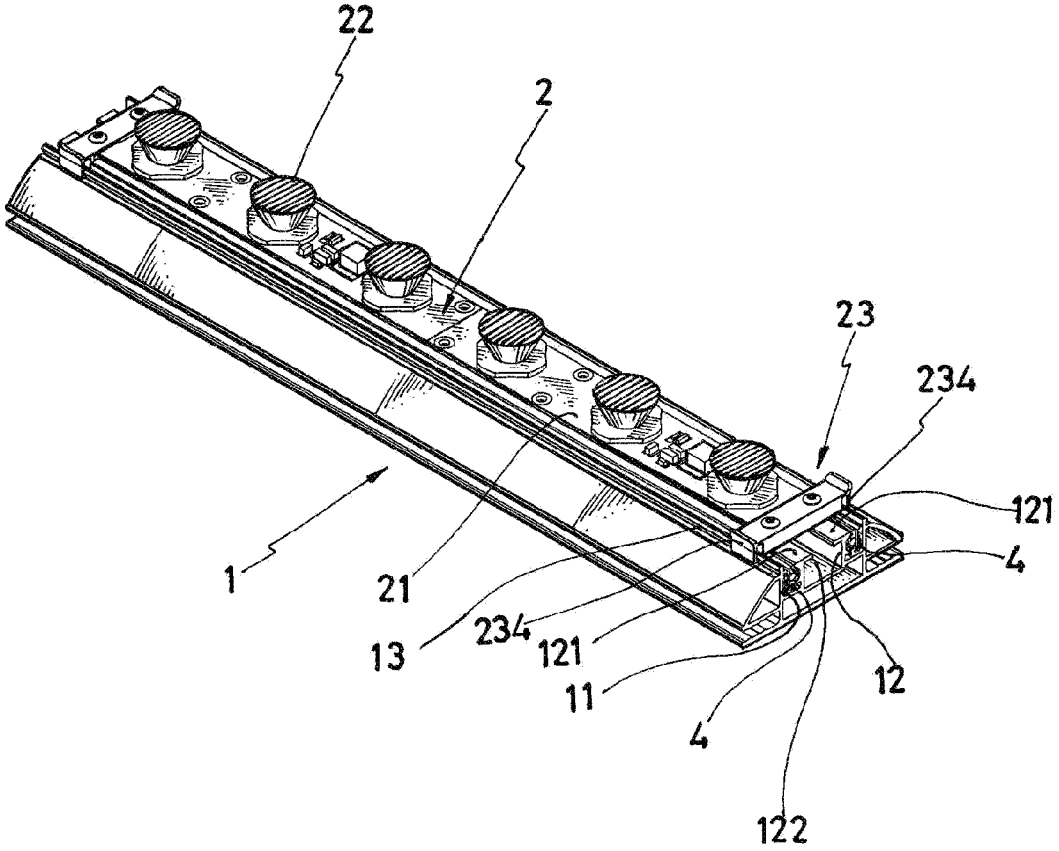
FIG. 1 is a perspective diagram showing a light emitting diode (LED) device according to an embodiment of the present invention.
Figure 2:
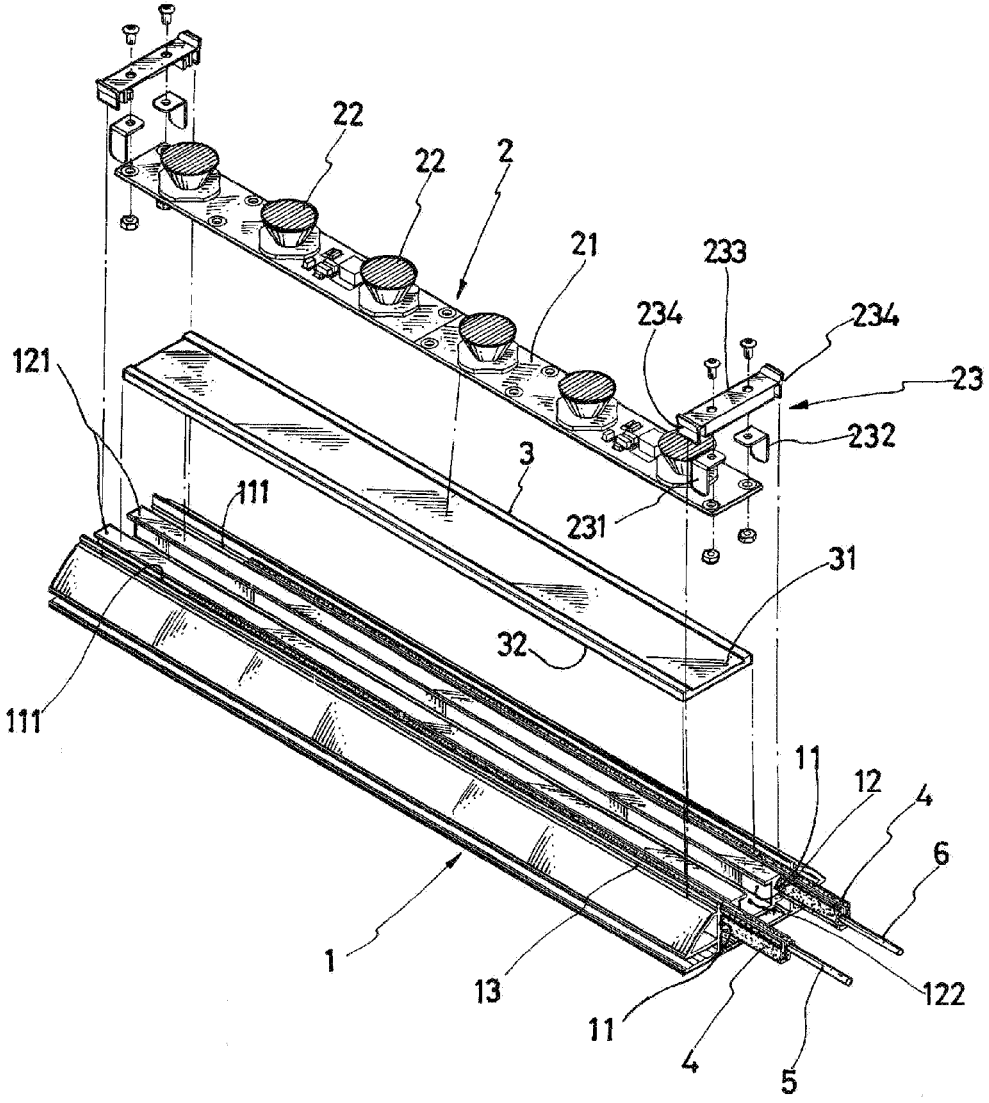
FIG. 2 is a perspective break-down diagram showing the LED device of FIG. 1.
Figure 3:
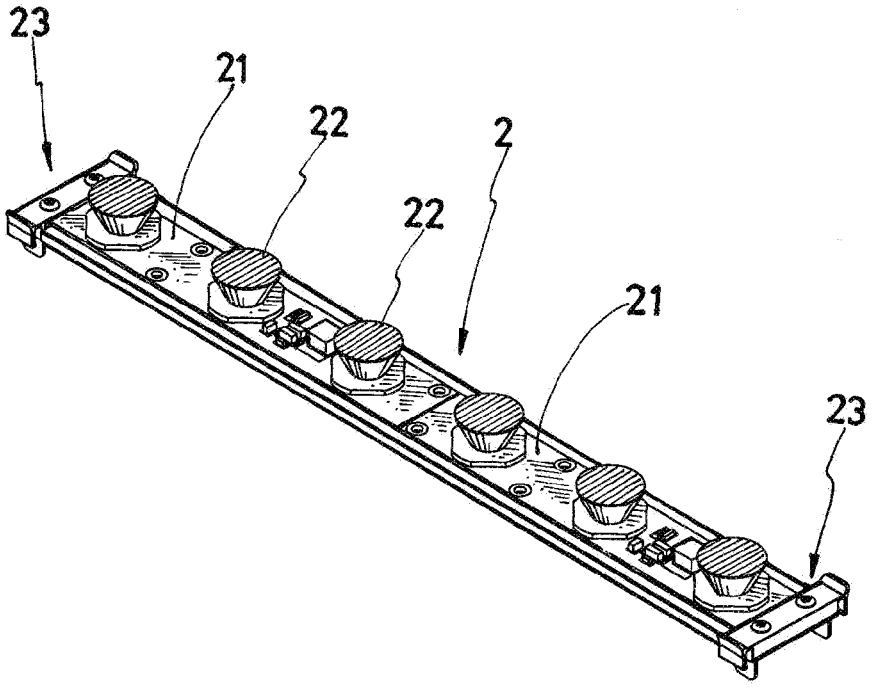
FIG. 3 is a perspective diagram showing the LED device of FIG. 1.
Figure 4:
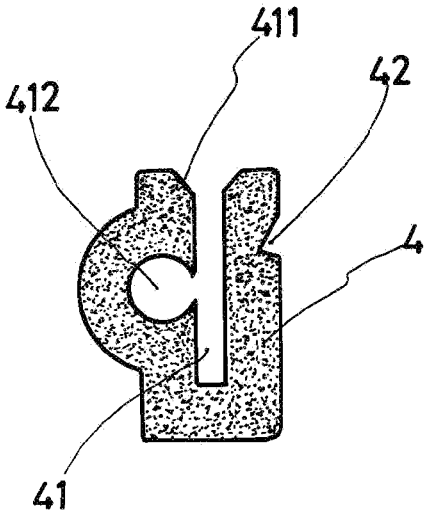
FIG. 4 is a cross-sectional diagram showing an insulating strip of the LED device of FIG. 1.
Figure 5:
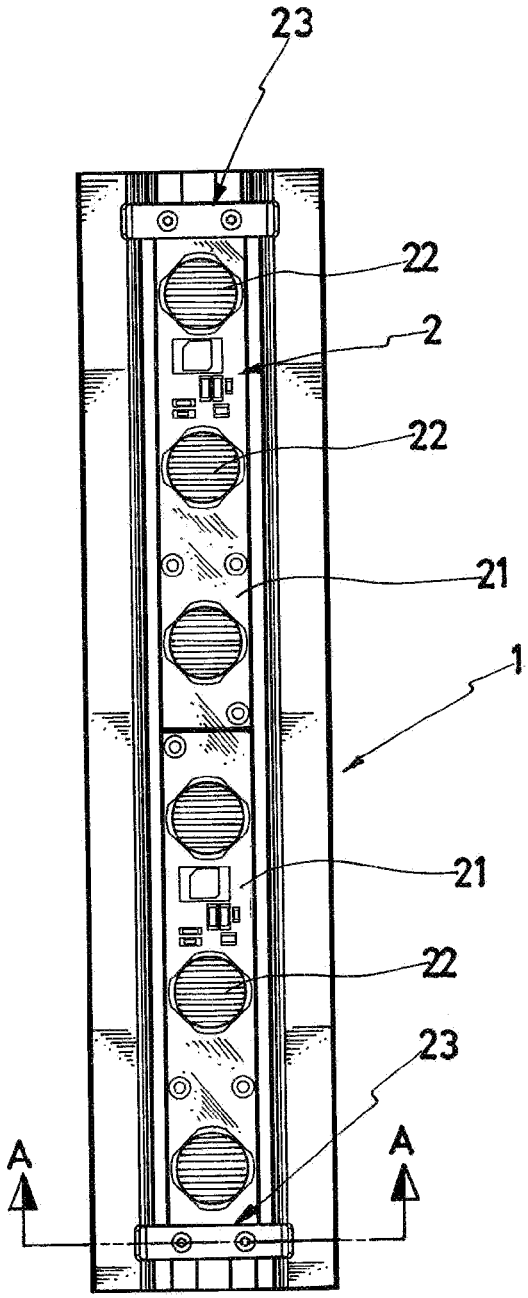
FIG. 5 is a top-view diagram showing the LED device of FIG. 1.
Figure 6:
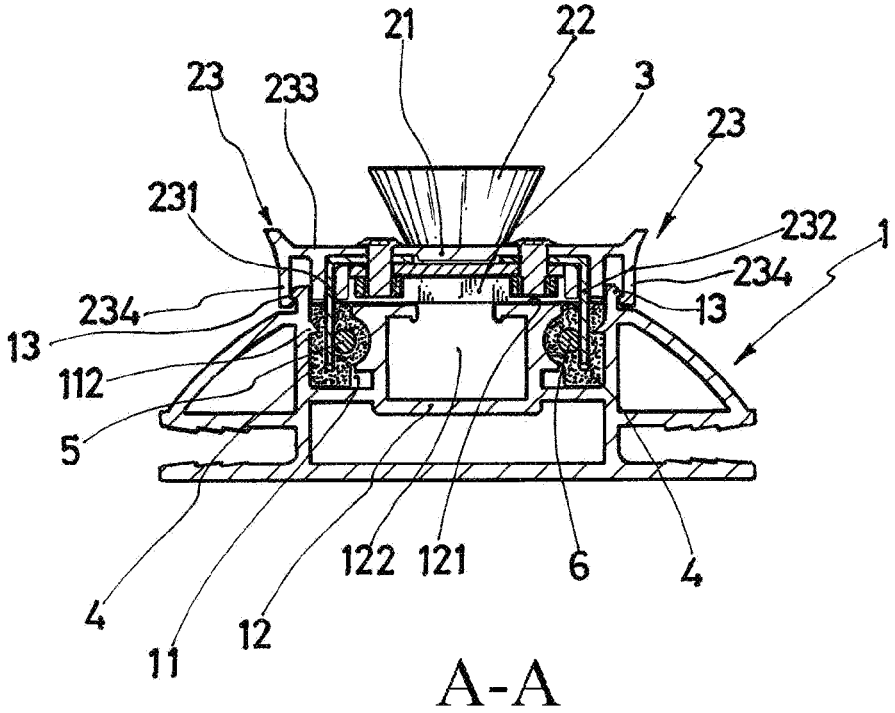
FIG. 6 is a cross-sectional diagram showing the LED device along the A-A line of FIG. 5.

As illustrated in FIGS. 1 to 6, a light emitting diode (LED) device according to an embodiment of the present invention contains an aluminum base 1, a LED lighting module 2, a heat dissipation plate 3, two insulating strips 4, a first conductive strip 5, and a second conductive strip 6.

The aluminum base 1 contains two first channels 11 arranged in parallel, and a heat dissipation channel 12 between the two first channels 11. Each first channel 11 has a top slot opening 111 and a rib 112 on an inner surface along the first channel 11's length. The heat dissipation channel 12 has an internal convection space 122 and the convection space 122 has a top opening partially covered by at least a top wall 121. Adjacent to each top slot opening 111, the aluminum base 1 is configured with a first locking element 13.

The first top slot openings 111, the top wall 121, and the two first locking elements 13 are all along the length of the aluminum base 1, and all face upward so as to achieve planar contact and fast heat dissipation with the heat dissipation plate 3.

The LED lighting module 2 is joined to a top side of the aluminum base 1, and the LED lighting module 2 contains a circuit board 21.

The circuit board 21 has one or more LED lighting elements 22 and the LED lighting elements 22 are connected to at least a connector assembly 23 configured at an end of the circuit board 21. The connector assembly 23 contains a first terminal 231, a second terminal 232, and a bridge element 233. The first terminal 231 has a first end electrically connected to a positive terminal of the circuit board 21. A second end of the first terminal 231 is extended downward to be below the circuit board 21. The second terminal 232 also has a first end electrically connected to a negative terminal of the circuit board 21. A second end of the second terminal 232 is extended downward to be below the circuit board 21. A second locking element 234 is configured at each end of the bridge element 233. Each second locking element 234 is locked to a corresponding first locking element 13. The bridge element 233 is made of a flexible material.

The locking between the second locking elements 234 and the first locking elements 13 mainly relies upon the flexibility of the bridge element 233. To remove or replace the LED lighting module 2, the second locking elements 234 are pressed and the second locking elements 234 would quickly break away from the first locking elements 13. Then, the LED lighting module 2 can be easily separated from the aluminum base 1 and replaced.

Each connector assembly can be fastened to the circuit board 21. For example, the first and second terminals 231 and 232 can first be electrically connected to the positive and negative terminals of the circuit board 21. Then the bridge element 233 is placed on top of the first and second terminals 231 and 232. Finally, bolts are applied to fasten the bridge elements 233, the first and second terminals 231 and 232 onto the circuit board 21.

The heat dissipation plate 3 is positioned between the aluminum base 1 and the LED lighting module 2. A first major side of the heat dissipation plate 3 is configured with a first heat conduction surface 31 and a second major side of the dissipation plate 3 is configured with a second heat conduction surface 32. The first heat conduction surface 31 is attached a bottom side of the LED lighting module 2. The second heat conduction surface 32 is attached to the top wall 121 of the aluminum base 1, so as to achieve fast and effective heat dissipation.

Each insulating strip 4 is threaded in a first channel 11. Each insulating strip 4 has a second channel 41 with a second top slot opening 411 corresponding to the first top slot opening 111 of the first channel 11. In a first lateral side wall of each second channel 41, a third channel 412 connecting and tangent to the second channel 411 is provided. On an outer surface of a second lateral side wall opposite to the first lateral side wall of each second channel 41, a notch 42 is provided. Each notch 42 corresponds to a rib 112 of the aluminum base 1. As the insulating strip 4 is placed in a first channel 11, the rib 112 is embedded into the notch 42 so that the insulating strip 4 is reliably positioned in the first channel 11.

Each of the first and second conductive strips 5 and 6 is threaded in the third channel 412 of an insulating strip 4. As each third channel 412 is connected and tangent to the second channel 411, each of the first and second conductive strips 5 and 6 is exposed in the second channel 411.

The first and second conductive strips 5 and 6 are for providing electricity to the LED lighting module 2. The advantages are convenience, flexibility in adapting to various length requirement, and reliable and uniform electricity provision, effectively resolving the problems of insufficient power and light attenuation.

The first conductive strip 5 is connected to an external predetermined positive terminal, and the second conductive strip 6 is connected to an external predetermined negative terminal.

As the LED lighting module 2 is joined to the aluminum base 1, and the second locking elements 234 are locked to the corresponding first locking elements 13, the second end of the first terminal 231 is extended into the second channel 41 of an insulating strip 4 through the first top slot opening 111 and the second top slot opening 411, and contacts the first conductive strip 5. Similarly, the second end of the second terminal 232 is extended into the second channel 41 of another insulating strip 4 through the first top slot opening 111 and the second top slot opening 411, and contacts the second conductive strip 6. In other words, when the LED lighting module 2 is joined to the aluminum base 1, their electrical connection is also established, therefore achieving two couplings with a single operation.

Additionally, when the LED lighting module 2 is joined to the aluminum base 1, the heat dissipation plate 3 conducts the heat from the LED lighting module 2 effectively and completely onto the aluminum base 1, whose convection space 122 quickly guides the heat outside.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A light emitting diode (LED) device comprising:

an aluminum base comprising two first channels arranged in parallel, and a heat dissipation channel between the two first channels where each first channel has a top slot opening partially covered by at least a top wall, the aluminum base is configured with a first locking element adjacent to each top slot opening, the first top slot openings, the top wall, and the two first locking elements are all along the length of the aluminum base, and all face upward;

a LED lighting module joined to a top side of the aluminum base where the LED lighting module comprises a circuit board, the circuit board has one or more LED lighting elements and the LED lighting elements are connected to at least a connector assembly configured at an end of the circuit board, the connector assembly comprises a first terminal, a second terminal, and a bridge element, the first terminal has a first end electrically connected to a positive terminal of the circuit board, the second terminal has a first end electrically connected to a negative terminal of the circuit board, the bridge element has a second locking element configured at each end, and each second locking element is locked to a corresponding first locking element;

a heat dissipation plate positioned between the aluminum base and the LED lighting module where a first major side of the heat dissipation plate is configured with a first heat conduction surface and a second major side of the dissipation plate is configured with a second heat conduction surface, the first heat conduction surface is attached a bottom side of the LED lighting module, and the second heat conduction surface is attached to the top wall of the aluminum base;

two insulating strips, each threaded in a first channel where each insulating strip has a second channel with a second top slot opening corresponding to the first top slot opening of the first channel, and, in a first lateral side wall of each second channel, a third channel connecting and tangent to the second channel is provided; and a first conductive strip and a second conductive strip where each of the first and second conductive strips is threaded in the third channel of an insulating strip, and each of the first and second conductive strips is exposed in the second channel;

wherein, as the LED lighting module is joined to the aluminum base, the second locking elements are locked to the corresponding first locking elements, the first terminal contacts the first conductive strip, the second terminal contacts the second conductive strip, and the second heat conduction surface contacts the top wall of the aluminum base.

2. The LED device according to claim 1, wherein the heat dissipation channel has an internal convection space.

3. The LED device according to claim 2, wherein each first channel has a rib on an inner surface along the first channel's length; each insulation strip has a notch on an outer surface; and each notch corresponds to a rib of the first channel.

4. The LED device according to claim 2, wherein the first terminal has a second end extended downward to be below the circuit board; and the second terminal has a second end extended downward to be below the circuit board.

5. The LED device according to claim 2, wherein the bridge element is made of a flexible material.

* * * * *